US009934762B1

(12) United States Patent
Jackson

(10) Patent No.: US 9,934,762 B1
(45) Date of Patent: Apr. 3, 2018

(54) PITCH CHANGING MECHANISMS FOR STRINGED MUSICAL INSTRUMENTS

(71) Applicant: David Jackson, Dahlonega, GA (US)

(72) Inventor: David Jackson, Dahlonega, GA (US)

( * ) Notice: Subject to any disclaimer, the term of this patent is extended or adjusted under 35 U.S.C. 154(b) by 0 days.

(21) Appl. No.: 15/390,950

(22) Filed: Dec. 27, 2016

(51) Int. Cl.
*G10D 3/06* (2006.01)
*G10D 1/08* (2006.01)
*G10D 3/14* (2006.01)

(52) U.S. Cl.
CPC ..... *G10D 3/06* (2013.01); *G10D 1/08* (2013.01); *G10D 3/14* (2013.01)

(58) Field of Classification Search
CPC ..... G10D 3/14; G10D 1/08
See application file for complete search history.

(56) References Cited

U.S. PATENT DOCUMENTS

2006/0185494 A1* 8/2006 Zumsteg ..... G10D 3/143 84/312 P
2014/0047968 A1* 2/2014 Bagale ..... G10D 1/08 84/267

* cited by examiner

*Primary Examiner* — Kimberly Lockett
(74) *Attorney, Agent, or Firm* — Buche & Associates, P.C.; John K. Buche; Bryce A Johnson

(57) ABSTRACT

Disclosed are pitch changing mechanisms, including fine-tuning and micro adjustment mechanisms. One mechanism is an adjustable tuning rod holder for a stringed instrument that is configured for both (A) fine tuning of the height of a pull-rod relative to a rod puller and pitch changer and (B) alignment the rod puller 1000 with the string 2500 on the instrument 2000. Other embodiments include roller nut and roller bridge housings. Yet still, disclosed are embodiments of pivot plates for fine or micro adjustments of the angle of a neck of a stringed instrument relative to the instruments body.

5 Claims, 15 Drawing Sheets

PITCH CHANGING MECHANISMS FOR STRINGED MUSICAL INSTRUMENTS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND AN INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of guitar effects. More specifically, this subject matter includes improvements to mechanisms that change the pitch of an instrument's string by raising and/or lowering its tension.

Background of the Invention

Stringed instruments, like guitars, produce sounds via string vibration. The pitch of sound produced by a vibrating string is dependent on many things, including the string's thickness, tension strength, and length. Thus, stringed instruments can have a range of sound pitch when the physical characteristics of their strings can be varied.

FIGS. 1A and 1B depict an example of typical pitch changing mechanism 1500 of a guitar 2000. FIG. 1A is a cross section of a guitar 2000 with a prior art pitch changing mechanism 1500. FIG. 1B is a perspective diagram of the pitch changing mechanism of FIG. 1A. As shown in FIGS. 1A and 1B, the mechanism 1500 is defined by at least one pitch changer 1510 (usually one per string of the instrument 2000). Suitably, the top of the pitch changer 1510, which is suitably designed to raise the tension of a string 1510 when activated, incorporates a string catch, for coupling the pitch changer 1510 to a string 2500 of a musical instrument 2000. As shown in FIG. 1A, strings 2500 are secured to the key head of an instrument 2000, passed over the bridge of the guitar 2000 before being mechanically coupled to the pitch changer 1510 via the string catch. Suitably, the connection of the string 2500 to the pitch changer 1510 allows a foot pedal assembly (not shown) to tighten or loosen the string 2500 to produce varied pitch sounds. FIG. 1B is a partially exploded view of a preferred embodiment of a string pitch changer housing 1500 with a single pitch changer 1510 depicted. Suitably, the pitch changer 1510 is pivotable around the pin 1580. As shown, the pitch changer 1510 is mechanically coupled to a pull-rod 1590 that is also mechanically coupled to a bell crank 1150 a bell crank finger 1151. The height of the pull-rod 1590 relative to the crank 1150 and pitch changer 1510 may be manipulated via coupling the pull-rod 1590 to a fixed and preset pull-rod receptacle 1153 (six shown) on one of the fingers 1151. The bell crank 1150 is mechanically coupled to a pivotable cross-bar 1152 that is controllable via the foot pedal assembly (not shown) so that the cross-bar 1152 of the bell crank 1150 is pivoted, the fingers move correspondingly to pull the pull-rod 1590, pivot the pitch changer 1510, and tauten or slacken the string 2500. Suitably, the a finger 1153 may be positioned variously along the cross-bar 1152 at fixed and preset locations 1154 that effectively align the finger 1153 with the string 2500 on the instrument 2000.

Problems arise in the typical pitch changing mechanism 1500. For instance, the fixed and preset pull-rod receptacles 1153 on the crank fingers 1153 do not allow for easy fine tuning of the height of the pull-rod 1590 relative to the crank 1150 and pitch changer 1510. Similarly, the fixed and preset locations 1154 on the cross-bar 1152 do not allow customized alignment of the finger 1153 with the string 2500 on the instrument. These problems result in a musician being unable to exactly set and manipulate the pitch of a string 2500 to his or her ideal specifications.

SUMMARY OF THE INVENTION

In view of the foregoing, an object of this specification is to disclose pitch changing mechanisms, including fine-tuning and micro adjustment mechanisms. One mechanism is an adjustable tuning rod holder for a stringed instrument that is configured for both (A) fine tuning of the height of a pull-rod relative to a rod puller and pitch changer and (B) alignment the rod puller 1000 with the string 2500 on the instrument 2000. Other embodiments include roller nut and roller bridge housings. Yet still, disclosed are embodiments of pivot plates for fine or micro adjustments of the angle of a neck of a stringed instrument relative to the instruments body.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which:

FIG. 22AA is a zoom in of FIG. 22;

FIG. 22BB is a zoom-in view of FIG. 22;

Figure 1A:
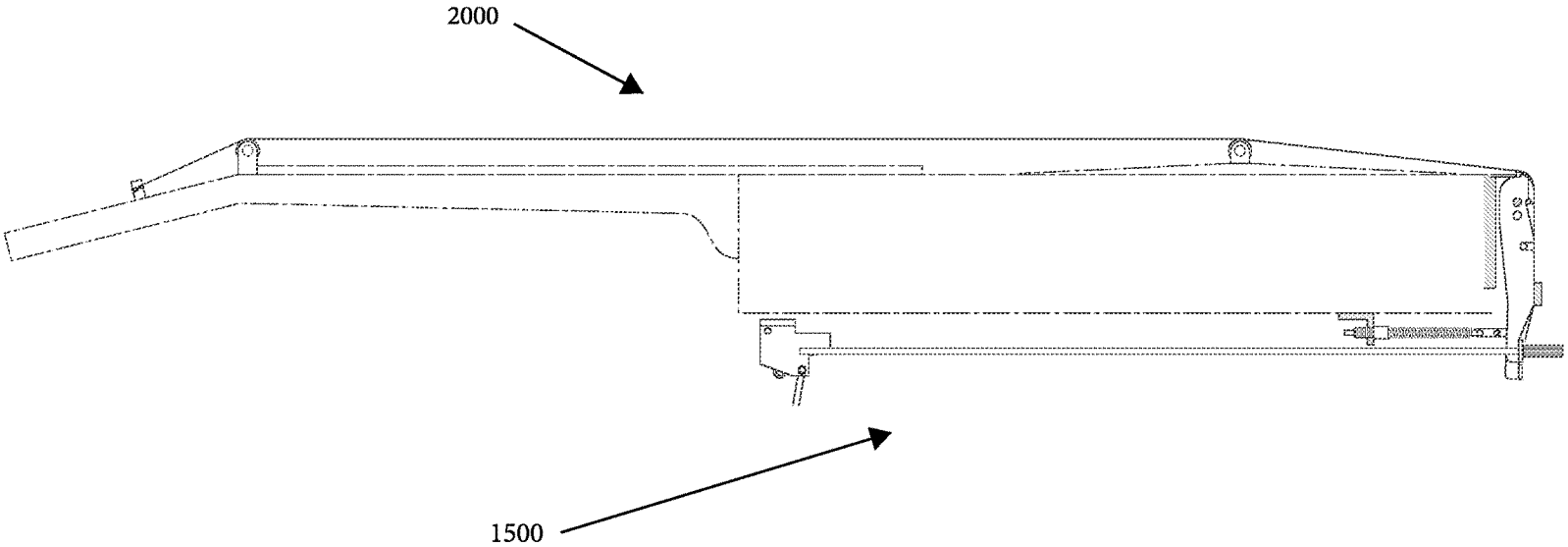
PRIOR ART FIG. 1A
FIG. 1A is a cross section of a guitar 2000 with a prior art pitch changing mechanism 1500.
Figure 1B:
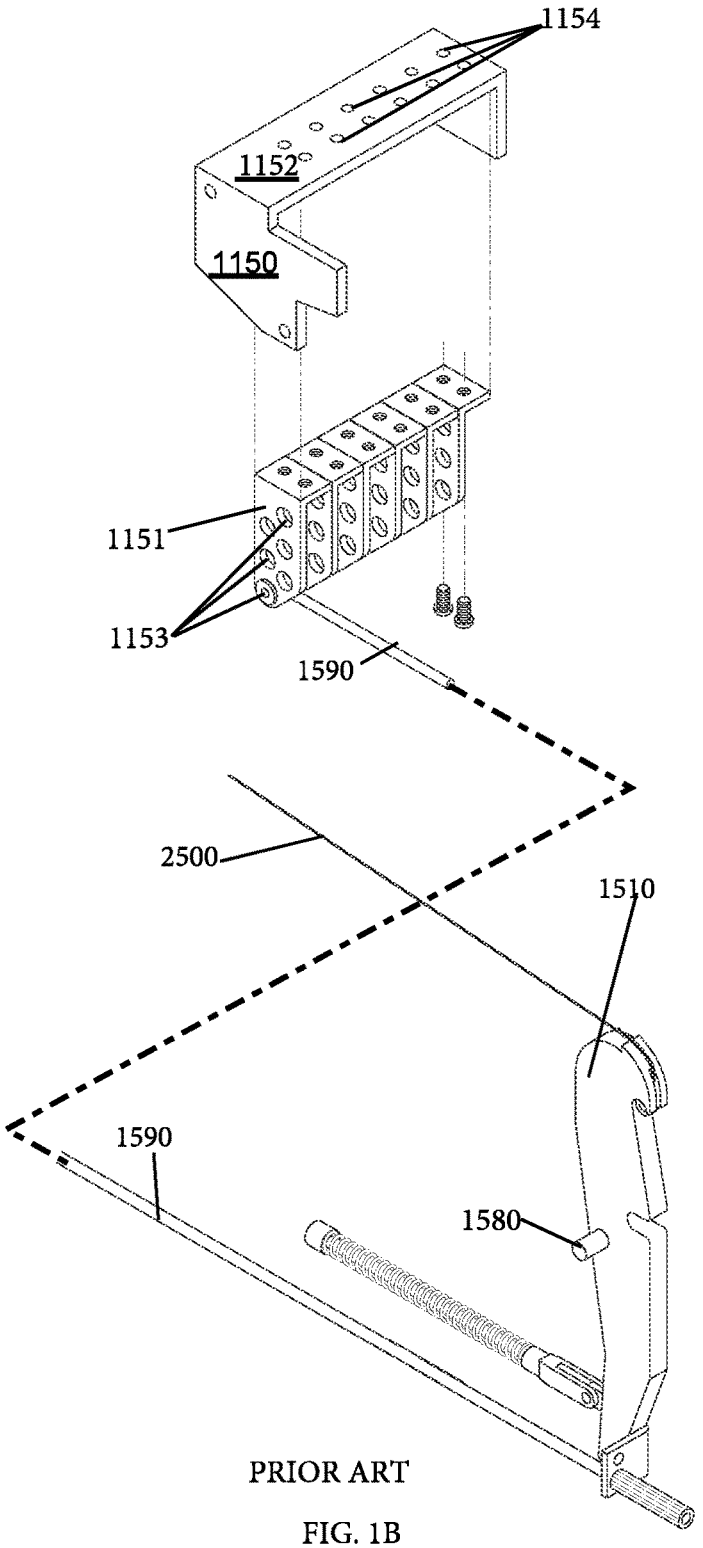
PRIOR ART FIG. 1B
FIG. 1B is a perspective diagram of the pitch changing mechanism of FIG. 1A.

In the figures, the following reference numerals represent the corresponding component:

1000—adjustable tuning rod puller;
1100—thumb-screw;
1150—bell crank;
1151—bell crank finger;
1152—cross-bar;
1200—pull-rod holder;
1210—rotating pull-rod collar with lock-screw;
1220—pull-rod;
1225—pull-rod slit;
1230—threaded aperture for the thumb-screw 1100;
1300—C-shaped anchor;
1310—thumb-screw receptacle;
1320—set-screw port;
1332—roller nut;
1333—roller nut housing;
1334—brass rollers;
1400—cross-rod;
1500—pitch changer assembly;
1510—pitch changer;
1580—pin;
1600—bridge housing;
1610—rollers;
1900—foot-pedal rod;
2000—guitar or other stringed instrument;
2100—neck of the guitar;
2150—neck pivot plate;
2151—body pivot plate;
2152—pivot screw;
2153—neck pitch adjustment screw;
2154—body plate;
2155—holes in the pivot plates;
2159—neck screw;
2199—threaded hole;
2200—neck support brace;
2250—support body plate;
2251—support head plate;
2500—string;
5000—nut; and,
6000—bridge.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

The Adjustable Tuning Rod Puller 1000.

Figure 1:
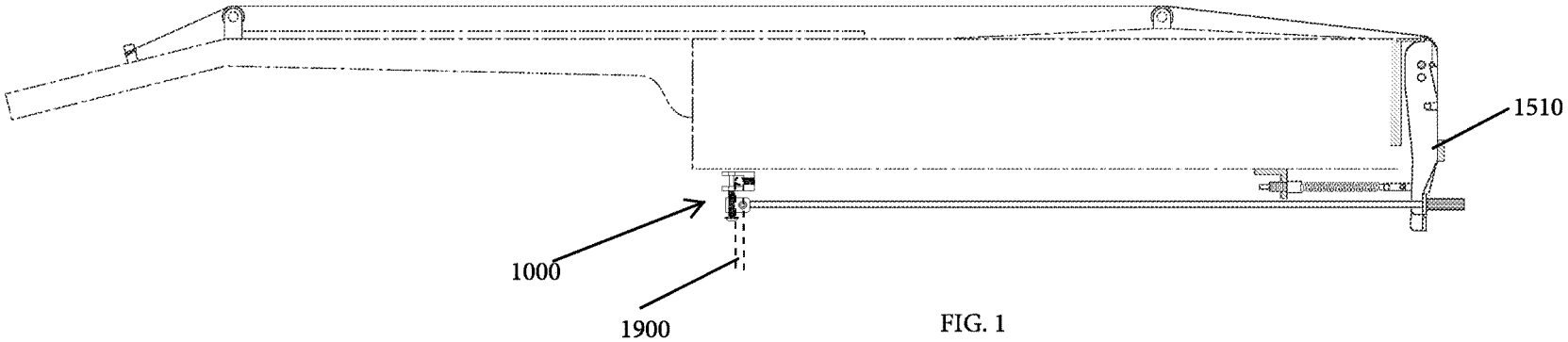
FIG. 1 is cross section of the adjustable tuning rod puller on a guitar 2000.

FIG. 1 is a contextual view of an adjustable tuning rod puller 1000 installed on a guitar 2000. As shown, the adjustable tuning rod puller 1000 suitably provided to the underside of the guitar 2000 and configured to, as discussed below, pivot in response to interaction with a foot pedal rod 1900. The adjustable tuning rod puller 1000 is suitably coupled to a pull rod 1220 that is mechanically coupled to a pivotable pitch changer 1510 at the butt of the guitar 2000. Suitably, a string 2500 from the key head of the guitar 2000 is coupled to the pitch changer 1510. In its most basic mode, the adjustable tuning rod puller 1000 may be installed and pivoted via action of the pedal rod 1900 to pull the pull rod 1220, pivot the pitch changer 1510, and pull or slacken the string 2500 of the guitar 2000. As discussed below, the adjustable tuning rod puller 1000 is configured for both (A) fine tuning of the height of the pull-rod 1590 relative to the rod puller 1000 and pitch changer 1510 and (B) aligning the rod puller 1000 with the string 2500 on the instrument 2000.

Figure 2:
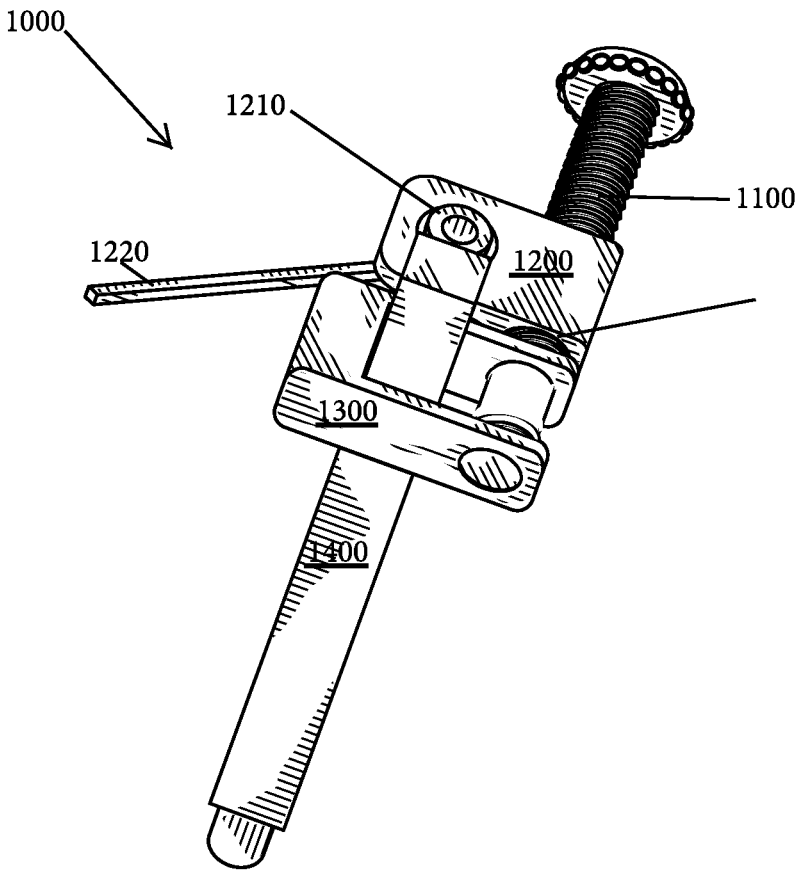
FIG. 2 is a perspective view of an adjustable tuning rod puller 1000 of FIG. 1.
Figure 3:
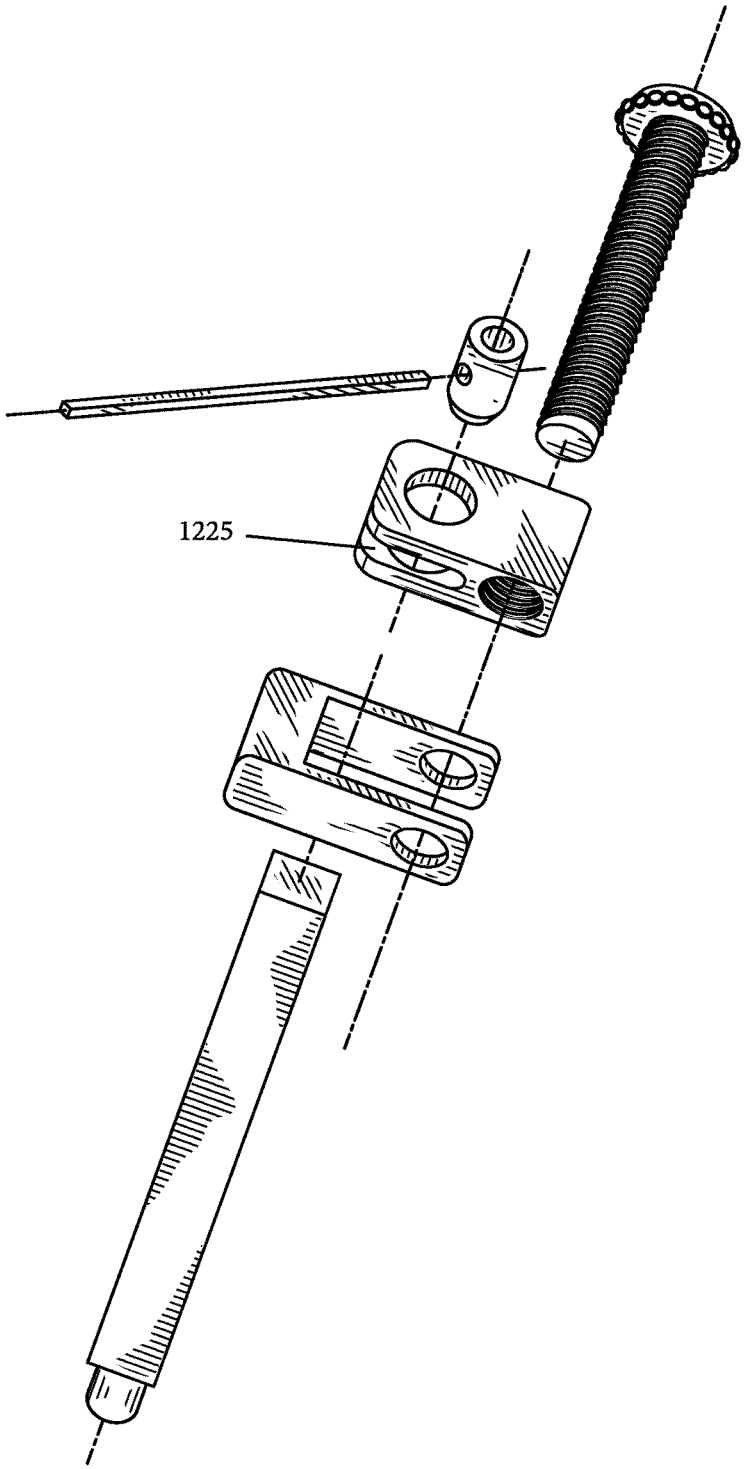
FIG. 3 is an exploded view of the adjustable tuning rod puller 1000 of FIGS. 1 and 2.
Figure 4:
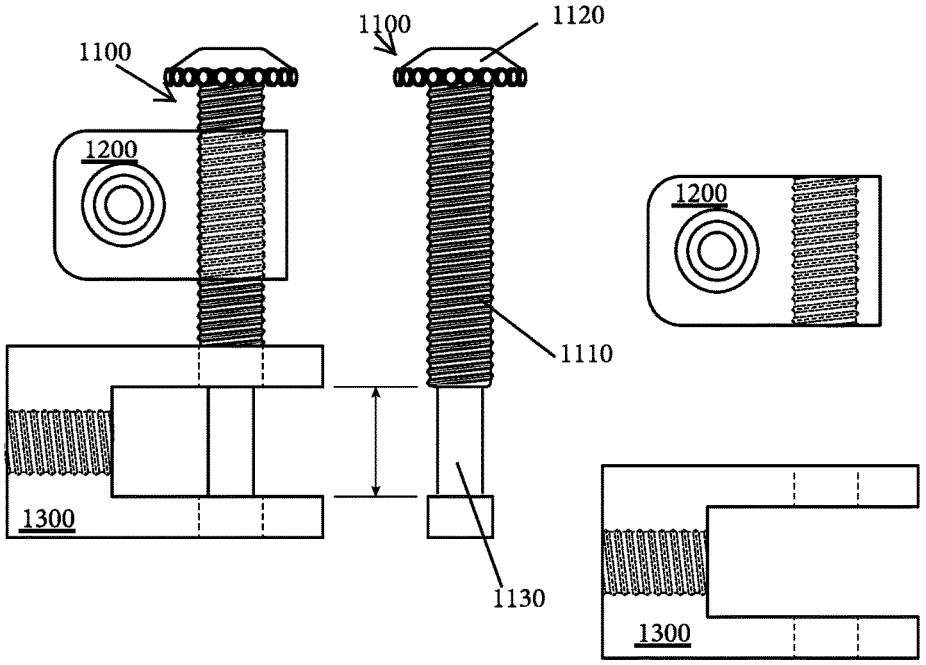
FIG. 4 is a side-by-side of a side view and exploded side view of the adjustable tuning rod puller 1000 of FIGS. 1 through 3.

FIG. 2 is a perspective view of an adjustable tuning rod puller 1000. FIG. 3 is an exploded view of the adjustable tuning rod puller 1000 of FIGS. 1 and 2. FIG. 4 is a side-by-side of a side view and exploded side view of the adjustable tuning rod puller 1000 of FIGS. 1 through 3. As shown in these figures, the adjustable tuning rod puller 1000 comprises four main sub-components: (1) the thumb screw 1100; (2) the pull-rod holder 1200 and pull rod 1220; (3) the C-shaped anchor 1300; and (4) the cross-rod or cross-bar 1400.

As shown in FIG. 2 through 4, the thumb screw 1100 is a threaded rod 1110 with a head 1120 and spacer 1130. Still referring to said figures, the pull-rod holder 1200 is a rectangular block with a threaded thumb screw aperture 1230, a pull-rod slit 1225, a rotating pull-rod collar 1210 with lock-screw that rotatably spans the pull rod slit 1225; and a pull rod 1220. Suitably, the pull rod 1220 is configured to enter the slit and be provided to the pull rod collar 1210 and locked in place. Yet still referring to the figures, the c-shaped anchor 1300 may suitably be a c-shaped block with a thumb screw receptacle 1310 across the arms of the c-shape block, a set screw port 1320 through the back end of the c-shaped block, and where the arms are configured to receive the cross-bar 1400 therebetween. Finally, the cross-bar 1400 is suitably a square bar. As shown, the cross bar 1400 is configured to be locked in between the arms of the c-shaped anchor 1300 via a set screw (not shown) through port 1320 that sets the cross bar 1400 against the spacer 1130 of the thumb screw 1100. It should be noted the pull rod 1220 could be secured via a right angle bent rod instead of a pull-rod collar 1210 where the right angle rod could be provided through the pull rod holder and clipped on the other side.

Referring to FIGS. 1 through 4, the location of the pull rod holder 1200 along the thumb screw 1100 may be manipulated via turning the thumb screw 1100 relative to the pull rod holder 1200. In this way, fine tuning of the height of the pull-rod 1590 relative to the rod puller 1000 and pitch changer 1510 may be accomplished. Still referring to FIGS. 1 through 4, the location of the c-shaped anchor along the cross-bar 1400 may be manipulated via providing the cross-bar 1400 between the arms of the c-shaped anchor to a desired position and setting the set screw through the screw port 1320 until the cross-bar 1400 is set against the spacer 1130 of the thumb screw 1100. In this way, alignment of the rod puller 1000 with the string 2500 on the instrument 2000 can be accomplished.

The Roller Nut Assembly 1332 and the Bridge Housing 1600

Figure 5:
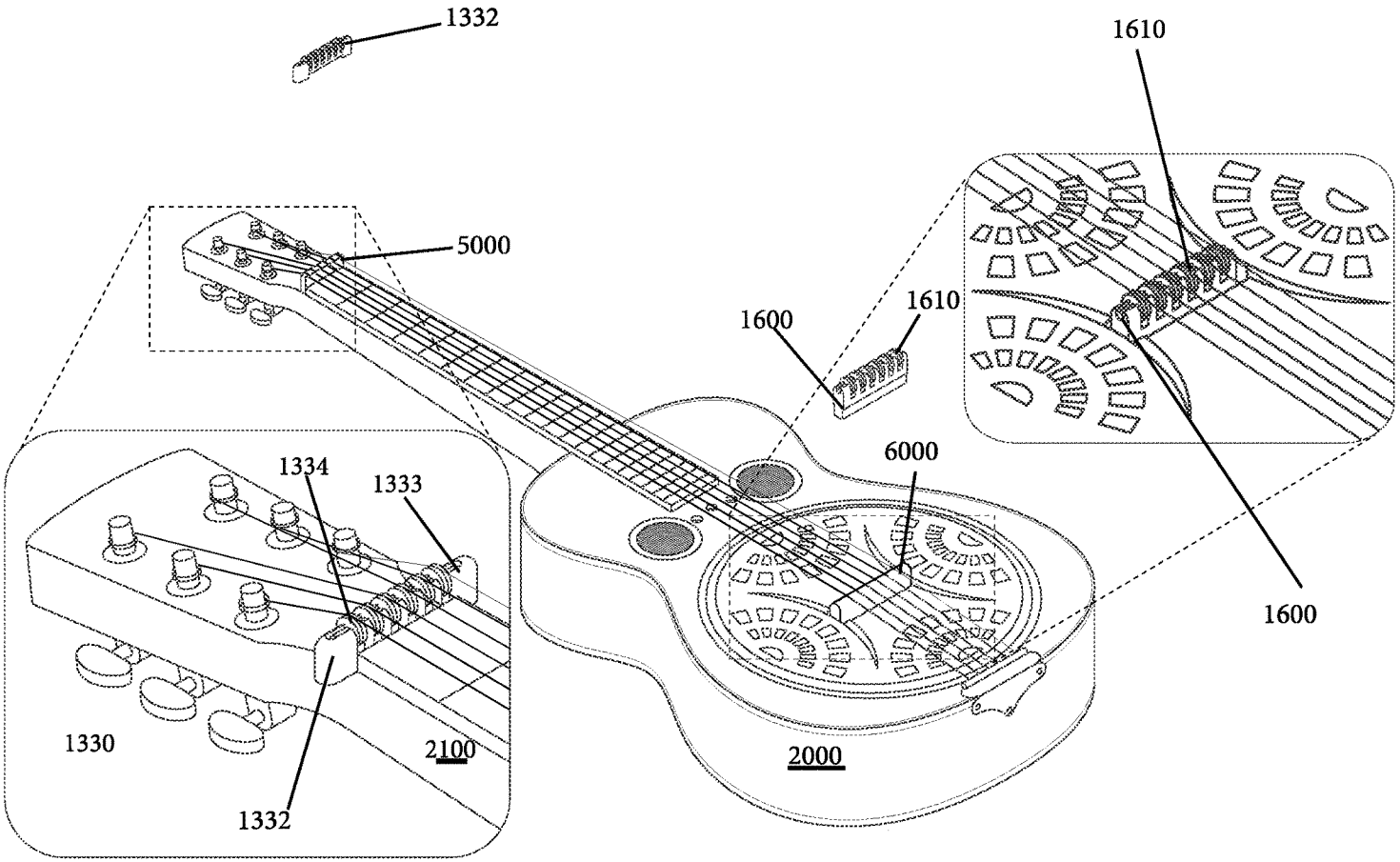
FIG. 5 is a perspective view of a guitar 2000 with enlarged views of an installed roller nut 1332 and an installed bridge housing 1600 with brass rollers 1610.
Figure 6:
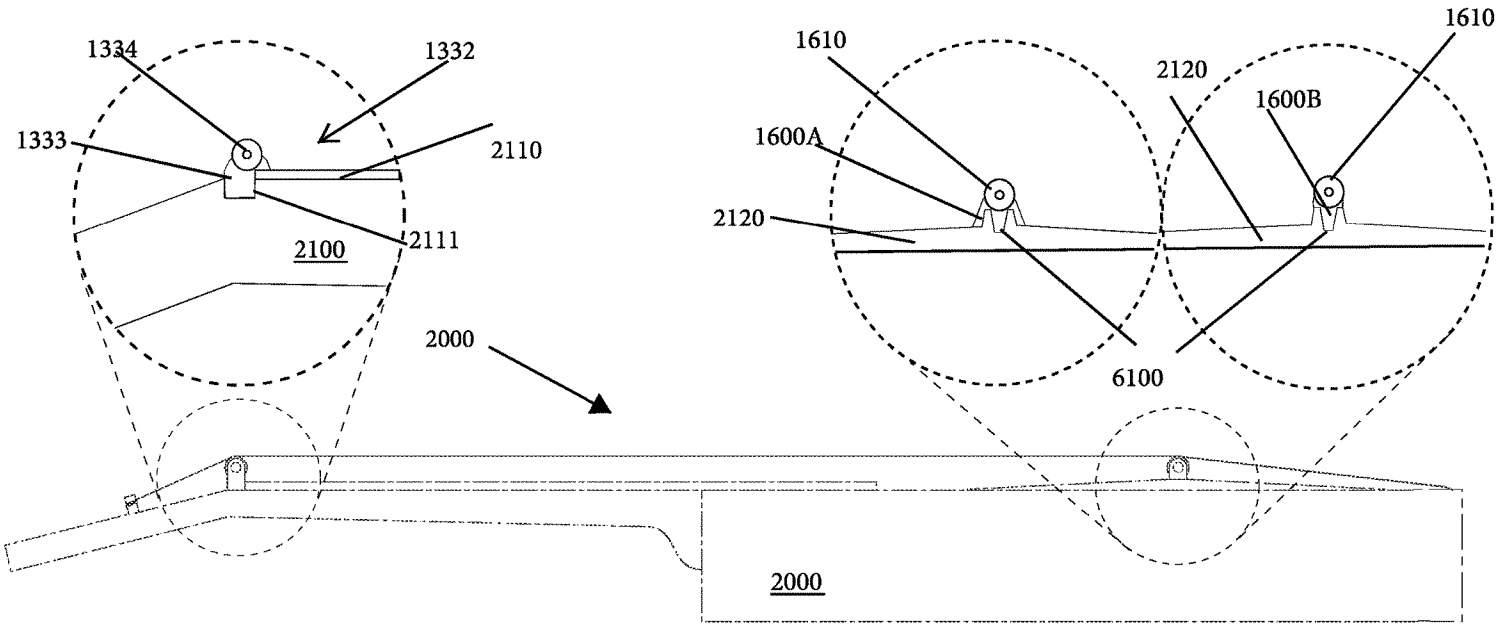
FIG. 6 is a side view of the guitar 2000 with enlarged cross-sections of the roller nut 1332 and bridge housing 1600.

FIG. 5 is a perspective view of a guitar 2000 with enlarged views of an installed roller nut 1332 and an installed bridge housing 1600 with brass rollers 1610. FIG. 6 is a side view of the guitar 2000 with enlarged cross-sections of the roller nut 1332 and bridge housing 1600. In one embodiment, a bridge housing 1600 with brass rollers 1610 replaces the existing bridge on the stringed musical instrument 2000. Correspondingly, a roller nut assembly 1332, which consists of roller nut housing 1333 and brass and gauged rollers 1334, is installed in the neck 2100 of the guitar 2000. In this embodiment, the roller nut 1332 replaces the nut of the guitar 2000 that is adjacent to the keyhead of the guitar 2000. Suitably, the roller nut assembly 1332 will fit into the groove that results from removal of said nut 5000, as shown.

As shown, the figures (FIGS. 5 and 6) illustrate the replacement of a standard nut 5000 and a standard bridge 6000 with respectively a roller nut assembly 1332 and a bridge housing 1600 with brass rollers 1610. Suitably, the standard nut 5000 may be removed from the neck 2100 of the guitar so that a slot 2111 is exposed adjacent to the fret board 2110 (see FIG. 6) where the housing 1333 of the roller nut assembly 1332 may be provided into the slot 2111 for completing installation. Concurrently, the standard bridge nut 6000 may be removed to expose a spider nut groove 6100, whereafter one embodiment of a bridge housing 1600A may be provided over and into the spider nut groove 6100 or an alternate embodiment of the bridge housing 1600B may be provided into the spider nut groove 6100 (shown in FIG. 6). In other words, bridge housing 1600 either rests (a) on the outside of the spider groove 6100 via receipt of the spider groove 6100 or (b) on the inside of the groove 6100 via insertion. Thus, the roller nut assembly 1332 and bridge housing 1600 may replace a standard nut 5000 and bridge 6000.

Figure 8:
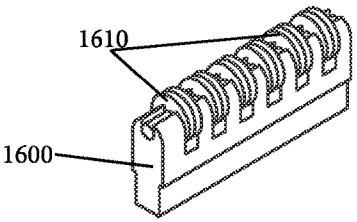
FIG. 8 is a perspective view of a roller bridge housing with brass rollers 1610.
Figure 7:
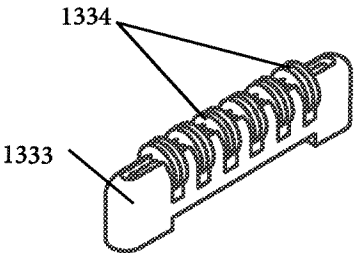
FIG. 7 is a perspective view of a roller nut housing with 1333 with brass rollers 1334

FIG. 7 is a perspective view of the roller nut housing with 1333 with brass rollers 1334 shown in FIG. 6. FIG. 8 is a perspective view of a roller bridge housing 1600A or 1600B with brass rollers 1610 shown in FIG. 6. As shown, the brass rollers 1334 and brass rollers 1610 are rotatable around central shaft positioned respectively in the nut housing 1334 or bridge housing 1600. In an alternate embodiment, each brass roller 1334/1610 could be rotatable around between pointed set screws.

Figure 9:
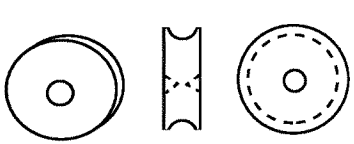
FIG. 9 is a side-by-side perspective, front and side view of a brass roller 1334/1610.

FIG. 9 is a side-by-side perspective, front and side view of a brass roller 1334/1610. As shown, the rollers may suitably be a disc with a groove for receiving a string around the outside edge. In one embodiment, the groove is round in cross section and configured to receive a round string. In a preferred embodiment (shown in the front and side view of the brass roller 1334/1610) the brass roller is configured to receive a pin or shaft through the center for providing an axis about which the roller 1334/1610 may rotate.

Figure 10:
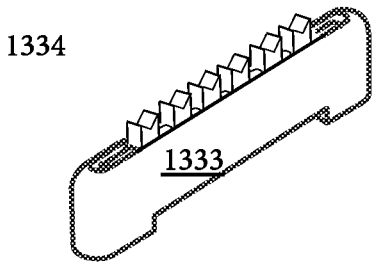
FIG. 10 is a perspective view of an alternate embodiment of roller nut 1332.
Figure 11:
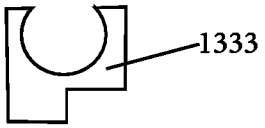
FIG. 11 is a cross section of the roller nut housing 1332 of the roller nut 1332 shown in FIG. 12 is a perspective view of an alternate embodiment of a roller bridge housing.
Figure 12:
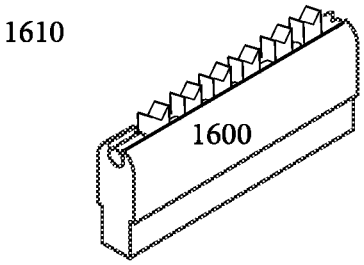
Figure 13:
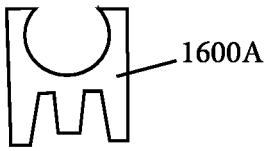
FIG. 13 is a cross-section of the roller bridge housing 1600 shown in FIG. 12.
Figure 14:
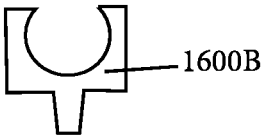
FIG. 14 is an alternative cross section of the roller bridge housing 1600 shown in FIG. 12.
Figure 15:
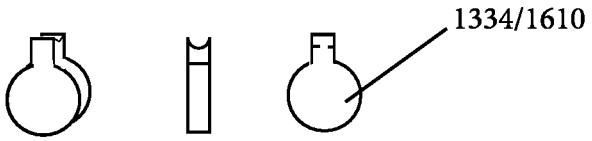
FIG. 15 is a side-by-side perspective, front and side view of a brass roller 1334/1610.

FIG. 10 is a perspective view of an alternate embodiment of roller nut 1332. FIG. 11 is a cross section of the roller nut housing 1332 of the roller nut 1334 shown in FIG. 10. FIG. 12 is a perspective view of an alternate embodiment of a roller bridge housing 1600. FIG. 13 is a cross-section of the roller bridge housing 1600 shown in FIG. 12. FIG. 14 is an alternative cross section of the roller bridge housing 1600 shown in FIG. 12. FIG. 15 is a side-by-side perspective, front and side view of a brass roller 1334/1610. As shown in these figures, the roller nut housing 1332 and bridge housing 1600 are installed on a guitar in substantially the same manner shown and described in connection with FIG. 6. A primary structural feature of the present roller nut housing 1332, bridge housing 1600 and brass roller 1334/1610 shown in FIGS. 10 through 15 is that the rollers 1334/1610 reside in slots cut into the housing and operate without a shaft axle. As shown in FIG. 15, the roller 1334/1610 features a leg grooved for the string where the leg will rock (move) with the string when the string is pulled.

Figure 16:
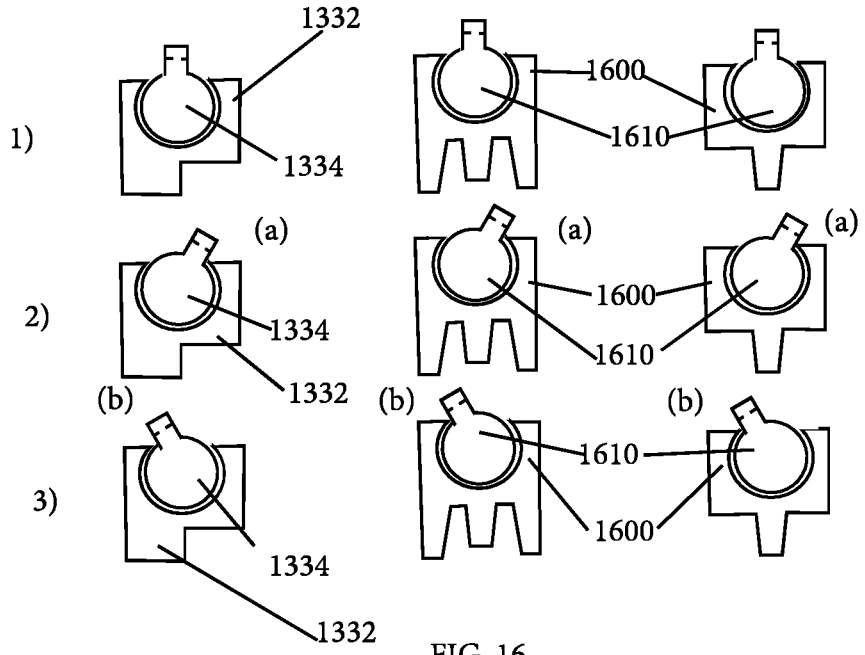
FIG. 16 is a grid of operation for the roller nut 1332, roller bridge housings 1600, and brass roller 1610 shown in FIGS. 10 through 15.
Figure 16A:
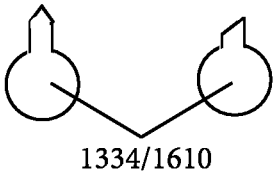
FIG. 16A is a view of alternate rollers 1334/1610.

FIG. 16 is a grid of operation for the roller nut 1332, roller bridge housings 1600, and brass roller 1610 shown in FIGS. 10 through 15. In normal operation, strings of a musical instrument move a max of 0.062 inches and a minimum of 0.015 inches in response to tuning changes or when strings are pulled by pitch changers. This embodiment of a roller and housing accommodate string movement by moving the roller in the direction of the string automatically in response to string pressure. In a preferred embodiment, the groove of the rollers may be concentric. In the grid, the left column shows a roller 1334/1610 inside of the roller nut housing 1332, the center column shows the roller 1334/1610 inside of a housing 1600 shown in FIG. 13, the right column shows a roller in 1334/1610 in a housing 1600 shown in FIG. 14, row 1) shows the roller 1134/1610 in a central position, row 2) shows the roller 1334/1610 in forward stop position, and row 3) shows the roller 1334/1610 in a rearward stop position. As shown in FIG. 15, the roller 1334/1610 features a leg grooved for the string where the leg will rock (move) with the string when the string is pulled. This rocking motion is shown in the grid, referring to row 1) of FIG. 16, a string (not shown) may be positioned over a roller 1334/1610 in a central position so that if the string (not shown) is pulled forward, the roller 1334/1610 will rock to the forward position of row 2). Alternatively, the roller 1334/1610 will rock to the rearward position of row 3) when the string (not shown) is pulled rearward. Suitably, the leg of the roller will stop movement when contacting the edges (a) and (b) so that the scale of the string can be controlled. Suitably, the string may slide through the grove as in connectional tuning when the string is tuned beyond the edges (a),(b). Suitably, the rollers 1334/1610 are configured to auto-adjust between the two edges (a), (b) during usage. In operation, the rollers will roll back and forth when strings are pulled by pitch changers. In a forward stop position (b), the string will hold on scale, and move to a rearward stop position (a) during manipulation of the a pitch changer. However, string pressure will cause the roller to return to a forward stop position (b) automatically when the pull of the string changer is released. FIG. 16A shows an alternate embodiment of the rollers 1334/1610. As shown in FIG. 16, the rollers move between point (a) and (b) during pitch changes. That distance is typically never more than 1/16 of an inch. So, the contact point of the string and the roller 1134/1610 may suitably define an edge so that dampening of the string is lessened.

Figure 17:
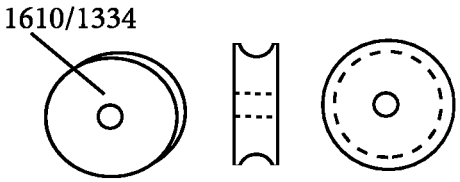
FIG. 17 is a side-by-side perspective, front and side view of a brass roller 1334/1610.
Figure 18:
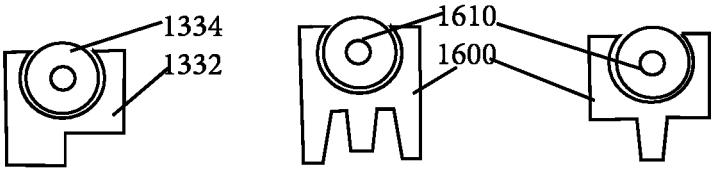
FIG. 18 is a grid of operation for the roller nut housing 1332, roller bridge housing 1600, and brass roller 1610 shown in FIGS. 17.

FIGS. 17 and 18 illustrate an alternate embodiment of the housing 1332, 1600 and roller 1334, 1610 where the leg is not included on the roller 1334/1610. In a preferred embodiment, the housing 1332, 1600 may feature receptacle for the roller 1334, 1610 that is about 0.010 to 0.015 inches larger diameter than the string roller 1334, 1610. Suitably, the string roller 1334, 1610 may be configured with a shaft axis so that the roller may float within the housing 1332, 1600 by being suspended therein on a shaft. Suitably, suspension of the roller on a shaft keeps the string roller 1334, 1610 of the housing, thus, allowing the string roller to freely move about the shaft axis and in within the housing 1332, 1600. The above roller system provides miniature housing dimensions for housing string rollers and could be made much cheaper by utilizing extruded housings and screw machined rollers as well as easy installation. Outside larger rollers could be staked to the housing to keep the assembly together. In the alternate embodiment shown in FIGS. 17 and 18, the rollers maintain a scale at all times because the roller is concentric with the housing 1334/1600.

The Pivot Plate 2150 and Other Mechanisms for Tilting a Guitar Neck 2100 Relative to the Guitar 2000

Figure 19:
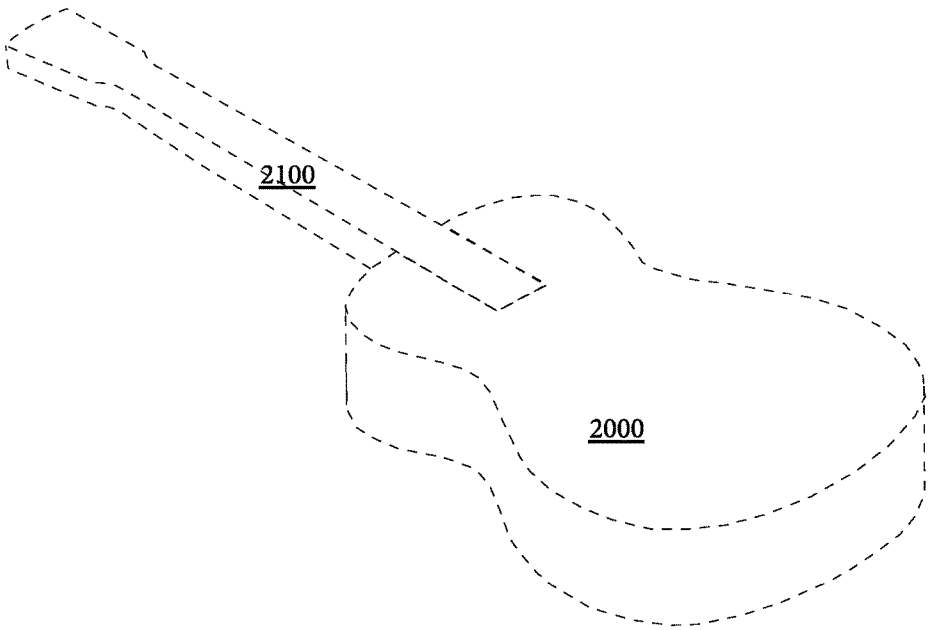
FIG. 19 is a perspective view of a guitar 2000 with a removable neck 2100.
Figure 20:
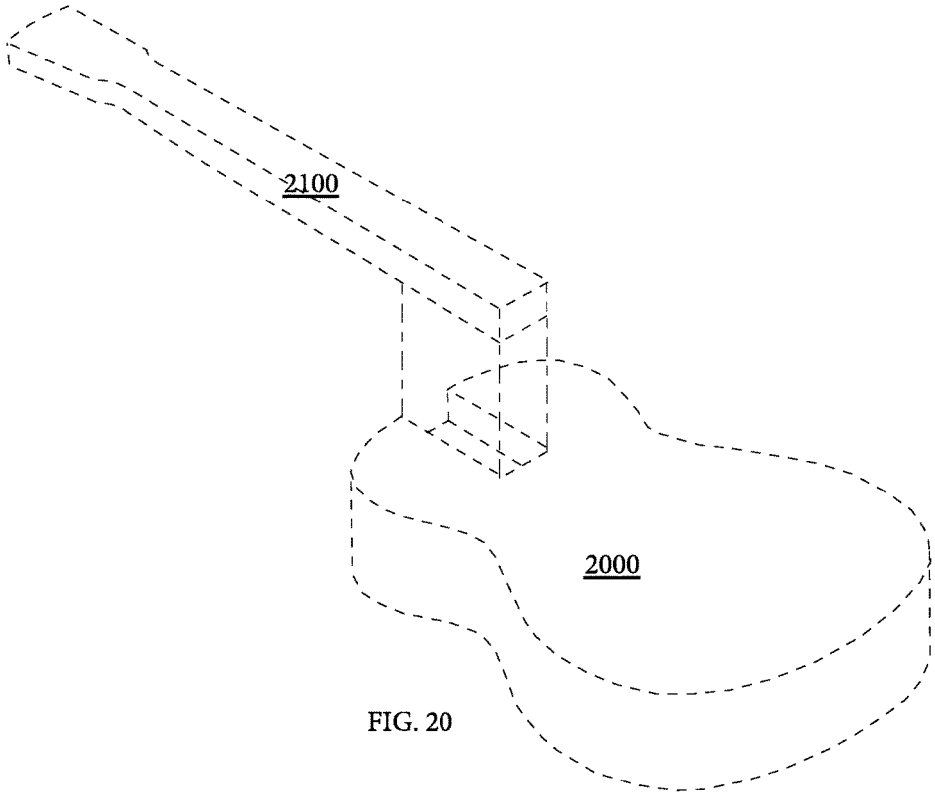
FIG. 20 is an exploded perspective view of guitar 2000 and neck 2100 of FIG. 19.
Figure 21:
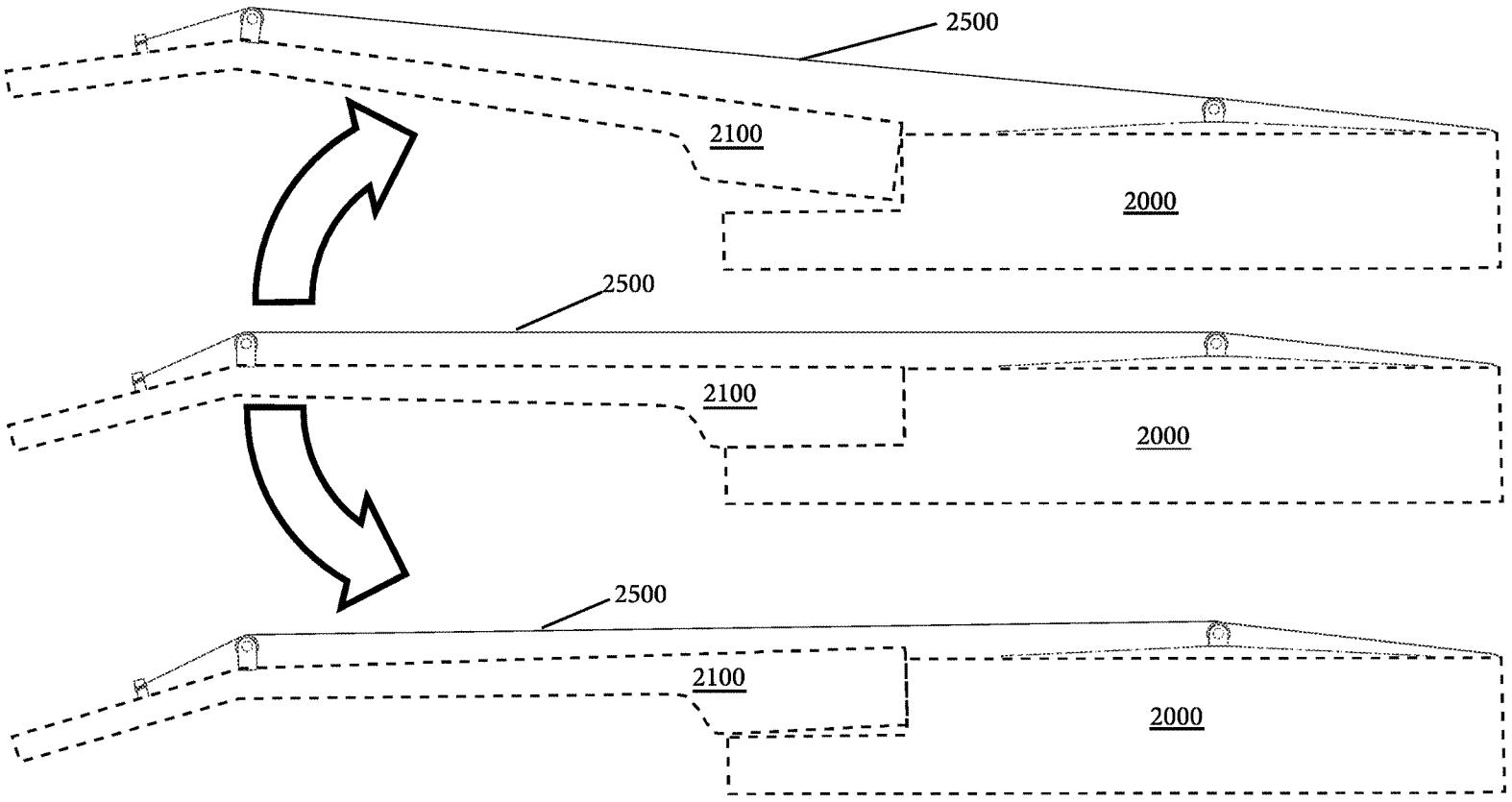
FIG. 21 is a diagram that illustrates the tilting of the neck 2100 of a guitar 2000 of FIGS. 19 and 20.

FIG. 19 is a perspective view of a guitar 2000 with a removable neck 2100. FIG. 20 is an exploded perspective view of guitar 2000 and neck 2100 of FIG. 19. As shown, a butt of the neck is provided into a corresponding slot of the guitar 2000. FIG. 21 is a diagram that illustrates the tilting of the neck 2100 of a guitar 2000 of FIGS. 19 and 20. Referring to this diagram, the angle of the neck 2100 may be adjusted relative to the body 2000. In some instances, the angle of the neck 2100 may be adjusted relative to the body 2000 to either (i) fine-tune or micro adjust the pitch of the guitar strings or (ii) adjust the height of the strings 2500 relative to the neck 2100 and guitar 2000. Those of skill in the art will appreciate the fine tuning of strings. The height of the strings 2500 relative to the neck 2100 and body 200 can be increased via tilting the neck upward (top of FIG. 21) and decreased via tilting the neck downward (bottom of FIG. 21). Suitably, string height may be adjusted to a musician's preference or to accommodate higher bridges by tilting the neck as described herein.

Figure 22:
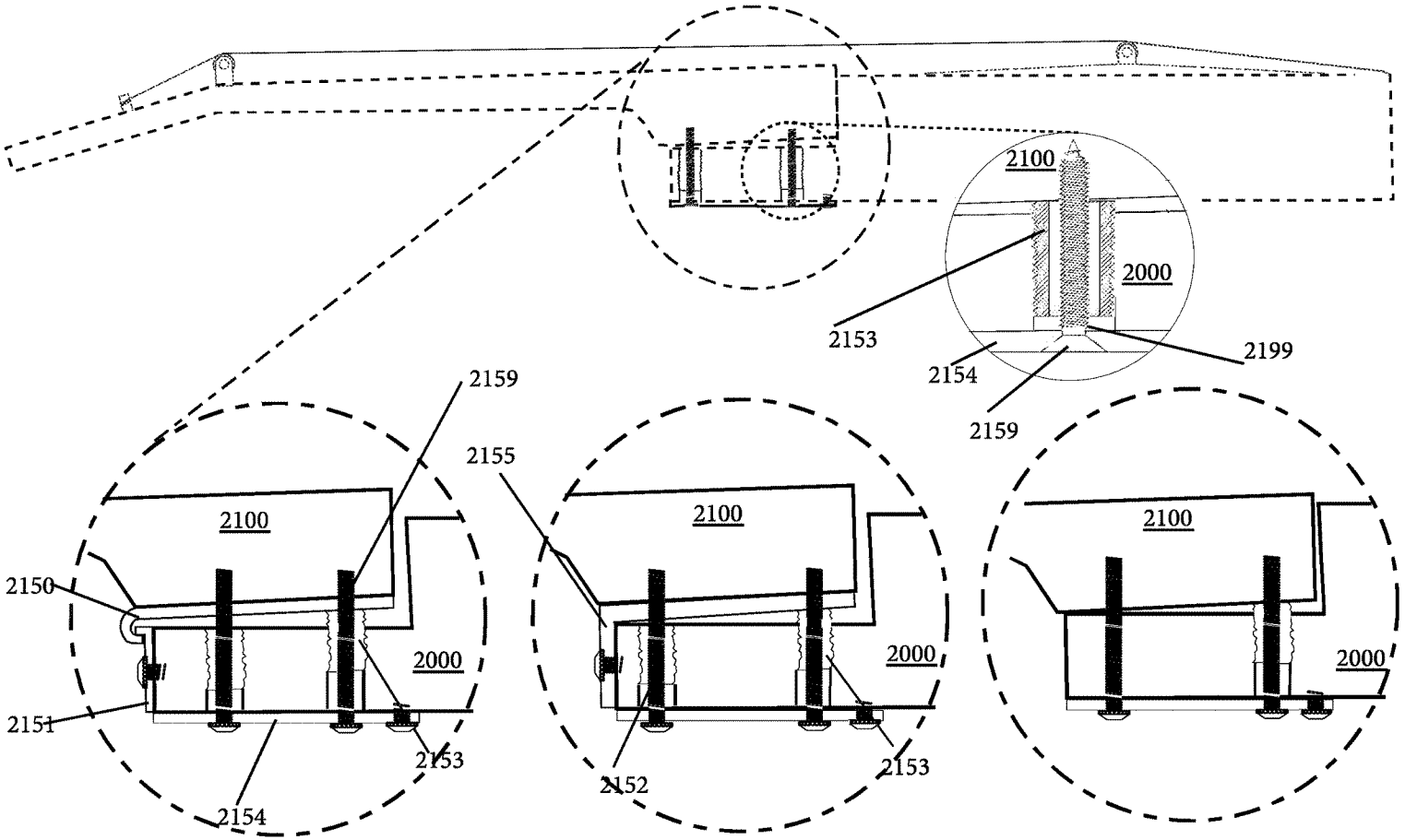
FIG. 22 is a diagram that illustrates the mechanisms for accomplishing the tilting of a neck 2100 of a guitar 2000.
Figure 22A:
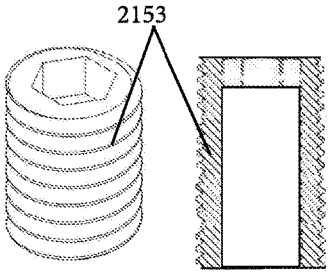
FIG. 22A is a perspective and cross section of neck pitch adjustment screw 2153.
Figure 22B:
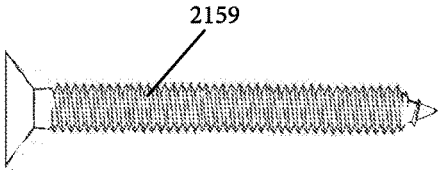
FIG. 22B is a side view of neck screw 2159.
Figure 22A:
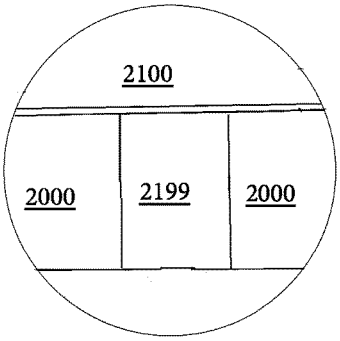
Figure 22B:
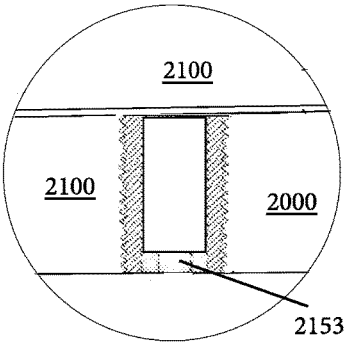

FIG. 22 is a diagram that illustrates the mechanisms for accomplishing the tilting of a neck 2100 of a guitar 2000 shown in FIG. 21. The figures feature four zoom-in views that illustrates three embodiments of tilting mechanisms. As shown, tilting may be accomplished according to three alternative embodiments. In a first embodiment shown in the far left zoom-in view, tilting is accomplished via a neck pivot plate 2150, a body pivot plate 2151, a neck pitch adjustment screw 2153, and a body plate 2154 and at least one neck screw 2159. Suitably, the neck pivot plate 2150 may be provided to the butt of the neck 2100 and the body pivot plate 2151 may be provided on adjacent to the neck receptacle of the guitar 2000. As shown, the neck pivot plate 2150 suitably features a hook or grove portion that is configured to receive a tongue portion of the body pivot plate 2151 when the neck 2100 is positioned into the receptacle of the guitar 2000. In a preferred embodiment, a neck pitch adjustment screw 2153 may be provided to body 2000 that may be manipulated via a wrench (e.g. Allen wrench) to move the neck up or down relative to the pivot screw. Suitably, the neck 2100 will tilt according to the manipulation of the neck pitch adjustment screw 2153 while the tongue and groove action of the neck pivot plate 2150 and body plate 2151 interact to ensure that the neck 2100 does not destructively interact with the body 2000 during pitch adjustments. Furthermore, the hook and groove of the neck pivot plate 2150 and body plate 2151 enable adjustment of the neck pitch without the screws 2152, 2153 installed so that an ideal pitch or string height may be assessed quickly and then set by installing the screws. The neck pivot plate further protects the neck so that the screws do not destructively interact with the neck 2100 during pitch adjustments. The body plate 2154 suitably prevents the screws from destructively interacting with the body 2000 by providing a seat for the screws. Once the pivot of the neck 2100 is at a desirable position, the neck screw 2159 may be provided through the neck pitch adjustment screw 2153 and into the neck 2100 to lock the neck to the body 2000 (see the upper right zoom-in view). The neck pitch adjustment screw 2153 and set screw are shown in more detail in FIGS. 22A and 22B. As shown in FIG. 22A, the neck pitch adjustment screw 2153 is an inner-hole screw with an Allen-wrench type receptacle above the smooth (unthreaded) inner bore. The neck pitch adjustment screw 2153 is configured for insertion into a threaded hole or bushing 2199 in the guitar 2000. The neck screw 2159 is a typical screw and is configured for insertion through the guitar 2000 via the inner hole of the pitch adjustment screw 2153 and into the neck 2100.

The center zoom-in view shows an alternate embodiment where a spring steel pivot plate 2155 is provided between the neck 2100 and the body 2000. In this embodiment, the may suitably pivot, as described above, around the pivot screw 2152 and bend in the spring plate 2155 via action of the neck pitch adjustment screw 2153. As shown in the far right zoom-in view, the tilting may be accomplished without any pivot plates. In a preferred embodiment, holes in the pivot plates 2150, 2155 for the neck pitch adjustment screws 2153 may be threaded for 3/8 set screws.

Figure 22C:
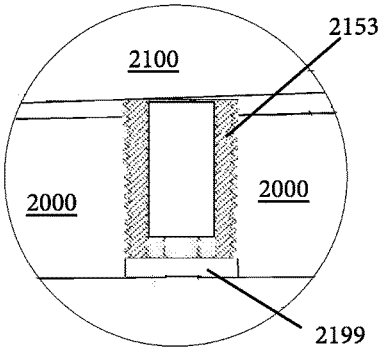
FIG. 22CC is a zoom-in view of FIG. 22.
Figure 22D:
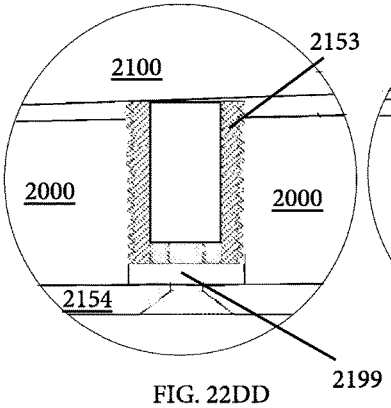
FIG. 22DD is a zoom in view of FIG. 22.
Figure 22E:
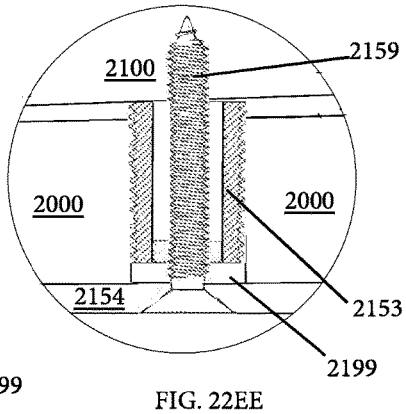
FIG. 22EE is a zoom in view of FIG. 22.

FIGS. 22AA through 22EE show how the pitch of the neck may be manipulated. Each of FIGS. 22AA through 22EE show the center zoom-in view of FIG. 22 at different stages of installation and neck 2100 pitch adjustment. In operation, the pitch of a string may be adjusted as follows. First, a pivot screw 2152 (shown in FIG. 22) may be loosened a 1/4 turn while the guitar strings are tuned. In some embodiments, two pivot screws will be employed and both would need to be loosened. Second, the neck pitch adjustment screw 2153 will be provided through the bushing 2199 of the guitar 2000 (FIGS. 22AA to 22BB) adjusted to the proper height above the body (FIG. 22CC). The neck plate 2154 may be already installed or put on the guitar at this point, as shown in FIG. 22DD. As with the pivot screws 2152, some embodiments could include two neck pitch adjustment screw 2153 and both would be adjusted in this step. Suitably, an Allen wrench, may be inserted into the empty bushings so that the top of the neck pitch adjustment screw 2153 pitch of the neck may be adjusted upward or downward. Third, the neck screw 2159 may be placed through the neck pitch adjustment screws 2153 at the proper pitch of the neck and the pivot screws 2152 tightened (FIG. 22EE). In one embodiment the bushings 2199 are threaded ⅜-16 with a 3/16 hole for screw to pace though and secure to the neck of the top bushing after the pitch is adjusted.

Figure 23:
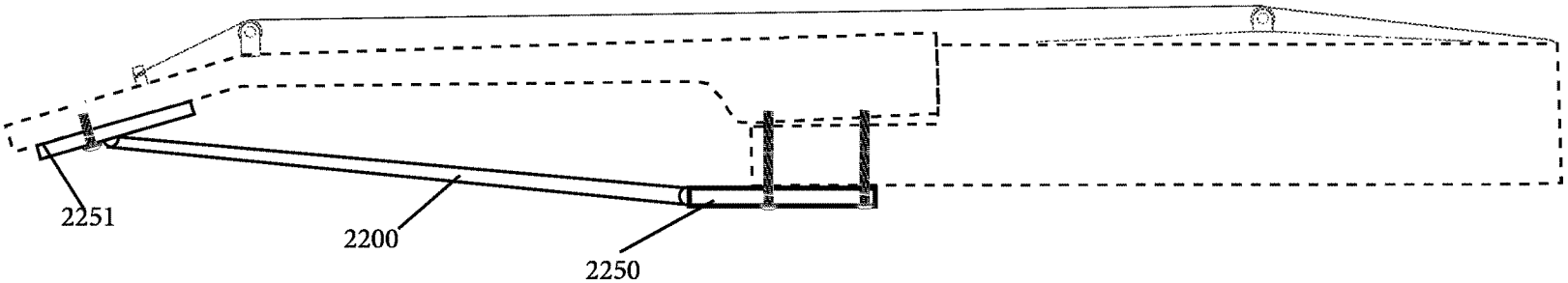
FIG. 23 is a side view of a neck support brace 2200.

FIG. 23 illustrates a side view of a guitar 2000 and neck 2100 with a neck support brace 2200 installed between the body 2000 and the head of the neck 2100. As shown the brace 2200 is defined by a truss 2252, a support body plate 2250, and a support head plate 2251. In a preferred embodiment, the truss 2252 may be tightened to offset string pressures when the strings 2500 are tightened via pitch changers. In a preferred embodiment the support body plate 2250 may be secured to the body of a guitar 2000 while the support head plate 2251 is secured to the head. The truss 2252 suitably stabilizes the neck 2100 from moving upward which a pitch changer is applied to the stings. Suitably, without the counterbalance of the truss 2252, the key head may lift up and relax all the strings 2500 when even one of the strings 2500 is pulled taut by a pitch changer.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A system of pivot plates for fine or micro adjustments of the angle of a neck of a stringed instrument relative to a body of the instrument, the system comprising:

a. a neck pivot plate;
b. a body plate;
c. a body pivot plate;
d. at least one pivot screw through the body plate, through the body of the instrument, through the neck pivot plate, and into the neck of the instrument;
e. a height or pitch adjustment screw in the body of the instrument and abutted with the neck pivot plate;
f. at least one set screw through the body plate, through the body of the instrument via an inner hole of said height or pitch adjustment screw, through said neck plate, and into said neck.

2. The system of claim 1 wherein the neck pivot plate is provided to a butt of the neck and the body pivot plate is provided on the body, adjacent to a neck receptacle of the instrument.

3. The system of claim 2 where the neck pivot plate features a hook or grove portion that is configured to receive a tongue portion of the body pivot plate when the neck is positioned into the receptacle of the instrument.

4. A system for fine or micro adjustments of the angle of a neck of a stringed instrument relative to a body of the instrument, the system of comprising at least:

a. a body plate that is secured to the body of the stringed instrument wherein said body features a neck receptacle of the stringed instrument;
b. a height or pitch adjustment screw movable within the body of the instrument, wherein an end of the height or pitch adjustment screw is adjustably protruding into the neck receptacle and wherein said end of the height or pitch adjustment screw is mechanically contacted with a butt of the neck of the instrument that is disposed in said neck receptacle; and,
c. at least one set screw through the body plate, through the body of the instrument via an inner hole of said height or pitch adjustment screw, and into said butt of said neck wherein said at least one set screw holds the butt in the neck receptacle against said end of the height or pitch adjustment screw.

5. The system of claim 4 wherein the body plate is provided on the body, adjacent to the neck receptacle of the instrument.

* * * * *